United States Patent [19]

Schmitt et al.

[11] Patent Number: 4,465,363

[45] Date of Patent: Aug. 14, 1984

[54] CLEANING DEVICE FOR CLEANING THE PERIPHERAL SURFACE OF A PHOTOCONDUCTIVE DRUM IN AN ELECTROPHOTOGRAPHIC COPIER

[75] Inventors: Klaus Schmitt, Wiesbaden-Erbenheim; Manfred Gehendges, Eltville, both of Fed. Rep. of Germany

[73] Assignee: Hoechst Aktiengesellschaft, Frankfurt am Main, Fed. Rep. of Germany

[21] Appl. No.: 442,468

[22] Filed: Nov. 17, 1982

[30] Foreign Application Priority Data

Nov. 27, 1981 [DE] Fed. Rep. of Germany ..... 3147001
Dec. 14, 1981 [DE] Fed. Rep. of Germany ..... 3149470

[51] Int. Cl.[3] ..... G03G 21/00

[52] U.S. Cl. ..... 355/15; 15/256.52; 355/77

[58] Field of Search ..... 355/15, 77, 3 R; 15/256.51, 256.52; 118/652

[56] References Cited

U.S. PATENT DOCUMENTS 3,907,423 9/1975 Hayashi et al. ..... 355/10
4,032,229 6/1977 Tani, formerly Nishikawa et al. ..... 355/15
4,080,059 3/1978 Tani, formerly Nishikawa et al. ..... 355/15
4,131,359 12/1978 Honda ..... 355/15
4,165,172 8/1979 Okamoto et al. ..... 355/15
4,279,501 7/1981 Kojima et al. ..... 15/256.52
4,364,660 12/1982 Oda ..... 15/256.51

FOREIGN PATENT DOCUMENTS 2758766 7/1978 Fed. Rep. of Germany .
2058669 4/1981 United Kingdom .

*Primary Examiner*—R. L. Moses
*Attorney, Agent, or Firm*—Schwartz, Jeffery, Schwaab, Mack, Blumenthal & Koch

[57] ABSTRACT

Disclosed is a cleaning device, having a cleaning roller and a scraper, which are capable of being brought into and out of contact with the photoconductive peripheral surface of a drum of a copier. The scraper further comprises a strip which is of a geometry such that in combination with the operation of the roller and scraper it allows for complete and efficient removal of the cleaning liquid from the drum surface without overflow and damage to the copier sub-assembly.

20 Claims, 10 Drawing Figures

CLEANING DEVICE FOR CLEANING THE PERIPHERAL SURFACE OF A PHOTOCONDUCTIVE DRUM IN AN ELECTROPHOTOGRAPHIC COPIER

BACKGROUND OF THE INVENTION

The present invention relates to a cleaning device for cleaning the peripheral surface of a photoconductive drum in an electrophotographic copier. More particularly, the invention is directed to a cleaning device which is capable of being brought into, and out of, contact with the peripheral surface, and which comprises a spray-tube for the supply of cleaning liquid, cleaning elements, such as a scraper, a cleaning roller, and a lever arrangement which positions the cleaning roller and the scraper.

In copiers utilizing liquid toner, the cleaning of the photoconductor is, in most cases, effected by means of a rubber-elastic scraper, in conjunction with a roller, the latter being made of a foamed material. A device of this type is described in German Auslegeschrift No. 2,600,950. In this known cleaning device spring arrangements are provided which attempt to pivotally lift the cleaning device from the photoconductor-drum. In order to prevent such separation, a lever, fastened to an outer end of a supporting shaft of the cleaning device, is provided which opposes the spring force of the spring arrangements and against the elastic forces of the cleaning device. By rotary movement, the free end of the lever is brought into engagement with a securing member, as a result of which the cleaning device is brought into pressure-contact with the peripheral surface of the drum. First and second lever arrangements which are in engagement with one another are provided for carrying the cleaning elements of the cleaning device.

A cleaning arrangement for a photoelectrostatic copier, with a scraper, is described in German Offenlegungsschrift No. 2,758,766. According to this disclosure, the copier comprises a first arrangement which brings the scraper out of contact with the photoconductor-drum, when the copier is not operating, and a second arrangement which pivots a cleaning roller out of contact with the photoconductor-drum or, at least, reduces the contact pressure thereof. In this arrangement, liquid developer is supplied as cleaning liquid to that portion of the photoconductor-drum which is located between the scraper and the squeeze-off roller. The apparatus for actuating the scraper and the squeeze-off roller are coupled together in such a manner that the scraper and the squeeze-off roller are simultaneously brought into, and out of, contact with the photoconductor-drum.

Cleaning devices are likewise described in U.S. Pat. Nos. 4,080,059 and 4,165,172, in which the device includes a cleaning roller and a rubber-elastic scraper, as well as a spray-tube for the supply of the cleaning liquid. The tube is located in such a manner that the cleaning liquid is dammed-up between the scraper, which is bearing against the peripheral surface of the photoconductor-drum, and the squeeze-off roller.

The known cleaning devices share the feature that, during the copying process, the rubber-elastic scraper, and the cleaning roller, together, are pivoted into contact with the photoconductor-surface. The cleaning liquid for wetting and rinsing the photoconductor surface is supplied between the scraper and the cleaning roller which, for example, may be of a foamed material.

In this step, the cleaning roller is utilized primarily for dissolving-off the residual toner-image from the photoconductor-surface. At the same time, the rubber-elastic scraper scrapes the liquid toner from the photoconductor-surface in such a manner that this surface is afterwards clean and dry. As a result of supplying cleaning liquid, generally liquid toner, between the cleaning roller and the scraper, the zone between the roller and the scraper is wetted, thus diluting the thickened toner adhering to the photocondcutor-surface in front of the scraper, and allowing for the toner to be rinsed away. In the case of drum-lengths of up to a maximum of 350 mm, which are used for copying-formats DIN A4 and DIN A3, the diluted toner can still flow away sufficiently rapidly towards the edges of the drum, without being dammed-up between the cleaning roller and the scraper. If, however, longer drums are to be cleaned, the problem arises in that toner is dammed-up between the scraper and the cleaning roller to an excessive height, because it cannot flow away to the edges quickly enough due to the long drum-length. If now, following completion of the copying and cleaning operation, the cleaning device is lifted off, the dammed-up toner runs off downwardly, over the drum surface, in a flood, resulting in possible wetting of the sub-assemblies, such as the corona and the paper feed devices, which are located in the vicinity of the photoconductor-drum, thus adversely affecting their operation.

Another disadvantage of a cleaning device of this type is that residues of toner liquid can dry on the surface of the drum. Because it is necessary that these residues be dissolved before the start of a new copying operation, a preliminary process step of applying the developer liquid or the cleaning liquid, which is generally the solvent for the toner, is required, as a result of which dissolving-off process the preliminary running time of the copier before a new copying cycle, is lengthened.

SUMMARY OF THE INVENTION

It is, therefore, an object of the present invention to develop an improved cleaning device for cleaning the peripheral surface of a photoconductor-drum.

Another object of the invention is to provide an apparatus and process for cleaning a photoconductor-drum which removes completely the liquid toner or developer liquid utilized therein.

A further object of the invention is the provision of an apparatus and process for cleaning a photoconductor drum which prevents overflow of the liquid toner, and thus, contamination of the subassemblies of the copier.

In accomplishing the foregoing objects, there has been provided in accordance with one aspect of the present invention a cleaning device for cleaning the peripheral surface of a photoconductive drum of an electrophotographic copier comprising a cleaning roller, a scraper including means for preventing liquid overflow, a strip, extending along the entire drum surface and positioned between the roller and the overflow prevention means, the strip having a downwardly outwardly sloping surface from the central apex toward the ends, and a lever device comprising a plurality of levers, one lever being separately positioned on a shaft from the remaining levers positioned on a surrounding sleeve and a plurality of cam-disks in pressure contact with the levers, respectively, for pivoting and positioning the roller and scraper.

According to another embodiment of the invention, the strip comprises a web having on its front face surfaces of varying slopes to provide improved and efficient removal of the cleaning liquid.

In accordance with an additional aspect of the present invention, there has been provided a process for cleaning the peripheral surface of a photoconductive drum of an electrophotographic copier comprising the steps of introducing a cleaning device comprising a cleaning roller and a scraper to the peripheral surface of the drum; individually controlling the contact pressure of the roller and scraper, the roller and scraper being positioned parallel to one another; supplying a cleaning liquid to the space between the roller and the scraper to contact the peripheral surface; upon completion of copying, individually applying increased pressure to the roller to cause more intimate contact with the drum and the scraper to squeeze the cleaning liquid therefrom; and lifting said cleaning device from the peripheral surface upon absorption by the roller of any remaining cleaning fluid.

Further objects, features and advantages of the present invention will become apparent to the person skilled in this art from the detailed description of preferred embodiments which follows, when considered together with the attached figures of drawing.

DETAILED DESCRIPTION OF PREFERRED EMBODIMENTS

In the cleaning device according to the invention, the lever arrangement, which comprises a plurality of levers, is located near one of the end-surfaces of the drum. Each of the levers carries, at its free end, ball bearings and one of the levers seats, via its other end, on a plug-in shaft, while the other levers seat on a sleeve. The plug-in shaft is connected to a first profile-section tube, and rotating cam-disks are installed above the lever arrangement, these cam-disks standing in pressure-contact, via the ball bearings, with the levers, to pivot these levers and thereby bring the cleaning elements into, and out of, contact with the peripheral surface of the drum. A strip is arranged between a splash guard and one of the cleaning elements, this strip extending over the full length of the drum and having a shape corresponding to a roof profile descending from the middle of the strip to the two ends.

In an exemplary embodiment of the invention, the cam-disks possess different shapes and pivot the levers at times which are delayed relative to one another and to different extents, so that the cleaning roller and the scraper can be set, separately and at different pressures, against the peripheral surface of the drum, and can be lifted separately from this drum.

Figure 2:
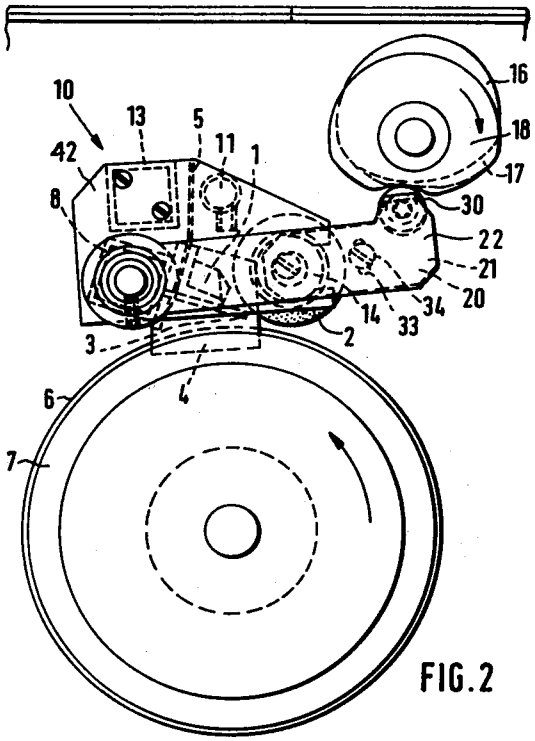
FIG. 2 is a side view of the cleaning device according to FIG. 1.
Figure 1:
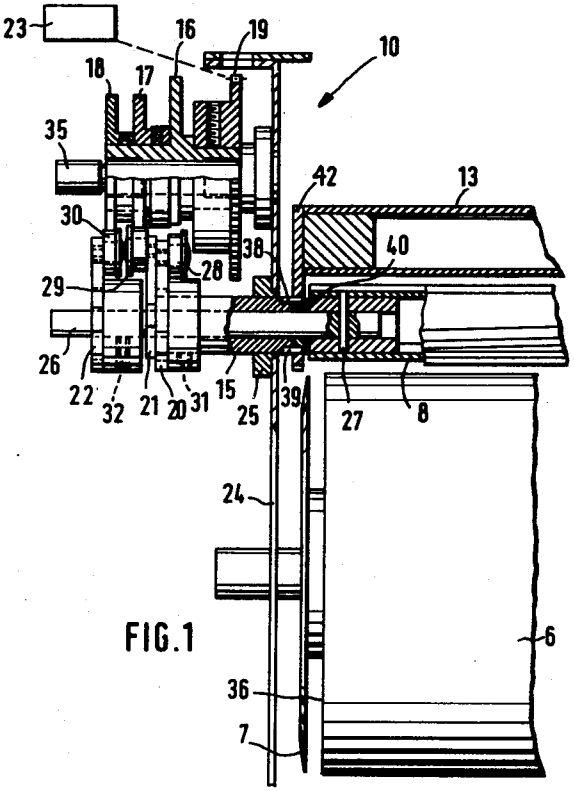
FIG. 1 is a partial sectional view of the exemplary embodiment of the cleaning device according to the invention.

In FIGS. 1 and 2, a cleaning device 10 is represented which includes a scraper 3, a cleaning roller 2 and a photoconductor-drum 6. The cleaning device 10 is not restricted to the cleaning of a photoconductive peripheral surface of a drum, but is equally suitable for cleaning both planar and non-circular curved surfaces.

The particular material for use with the cleaning roller 2 varies, with preferred materials possessing an appropriately high capacity for absorbing liquids, such as, for example, a foamed material. A drip-disk 7 is located on one of the end-surfaces 36 of the photoconductor-drum 6 for collecting liquid toner flowing in the axial direction away from the drum 6, and directing the toner downwardly into a liquid bath (not shown). By this means, liquid toner is prevented from contaminating sub-assemblies of the copier, which are located outside the region of the photoconductor drum.

The cleaning device 10 is located above the photoconductor-drum 6, and is bounded, at the sides, by plates, of which one sideplate 42 is represented. A plug-in shaft 26 is guided through the sideplate 42, by a plain bearing 40, which is pressed into the sideplate 42. A sleeve 15 is guided through a side-shield 24 of the copier, which runs parallel to the sideplate 42 and at a short distance from it. A plain bearing 25 for the sleeve 15 is located on the side-shield 24. The sleeve 15 surrounds the plug-in shaft 26, which is connected to a first profile-section tube 8, which is designed, for example, as a square profile-section tube. The connection of the plug-in shaft 26 to the first profile-section tube 8 is effected by means of a locking member 27, which passes through the plug-in shaft 26, at right angles to the axial direction. A scraper is fastened to the profile-section tube 8, this scraper being in the form of an elongated strip, with an edge formed thereon. The strip is made of an elastically resilient material, such as, for example, rubber, natural rubber, vinyl chloride, or the like. A lever 22 seats on the plug-in shaft 26, and is locked in its position by means of a clamping screw 32, the plug-in shaft 26 additionally serving as a bearing journal for the sleeve 15. Levers 20 and 21 are seated on this sleeve. The lever 20 is locked in its position by means of clamping screw 31. Each of the levers has, at its free end, a ball bearing 28, 29 and 30, respectively. Above the levers, rotating cam-disks 16, 17, 18 seat on a cam-disk shaft 35. The cam-disks have different shapes and stand in pressure-contact with the ball bearings 28, 29, 30. The cam-disks 16, 17, 18 are eccentrically shaped so that, during a revolution, the cam-disks pivot the levers and thereby bring the cleaning elements, which are fastened to the levers, into, and out of, contact with the peripheral surface of the drum 6. The cam-disks are arranged on the cam-disk shaft 35 in a manner whereby they are displaced relative to one another, so that they pivot the levers 20, 21, 22 at times which are delayed relative to one another, and to different extents. As a result of this arrangement, the cleaning roller 2 and the scraper 3 are separately set against the peripheral surface of the drum 6, at different pressures, and are separately lifted clear of this surface. As can be seen from FIG. 1, the cam-disks 16, 17, 18 seat on the cam-disk shaft 35 at positions adjacent to one another, being locked in their respective positions by screws (not shown in detail). A toothed drive-wheel 19 adjoins the cam-disk 16 and is connected, via a sprocket-chain (not shown), to a drive 23, represented diagrammatically in FIG. 1, such copier drives being known per se. The ends of a second profile-section tube 13 rest against the inner surfaces of the side plates 42, and are connected to the sideplates by means of screws (not shown in detail). The second profile-section tube 13 possesses a square shape, and functions to stiffen the cleaning device, which can have a length, for example, of more than 1 m. The bearings 14 for the bearing journals of the cleaning roller 2 are located in the oppositely-located sideplates 42, at a distance from the plain bearings 40 for the plug-in shaft 26.

Figure 6:
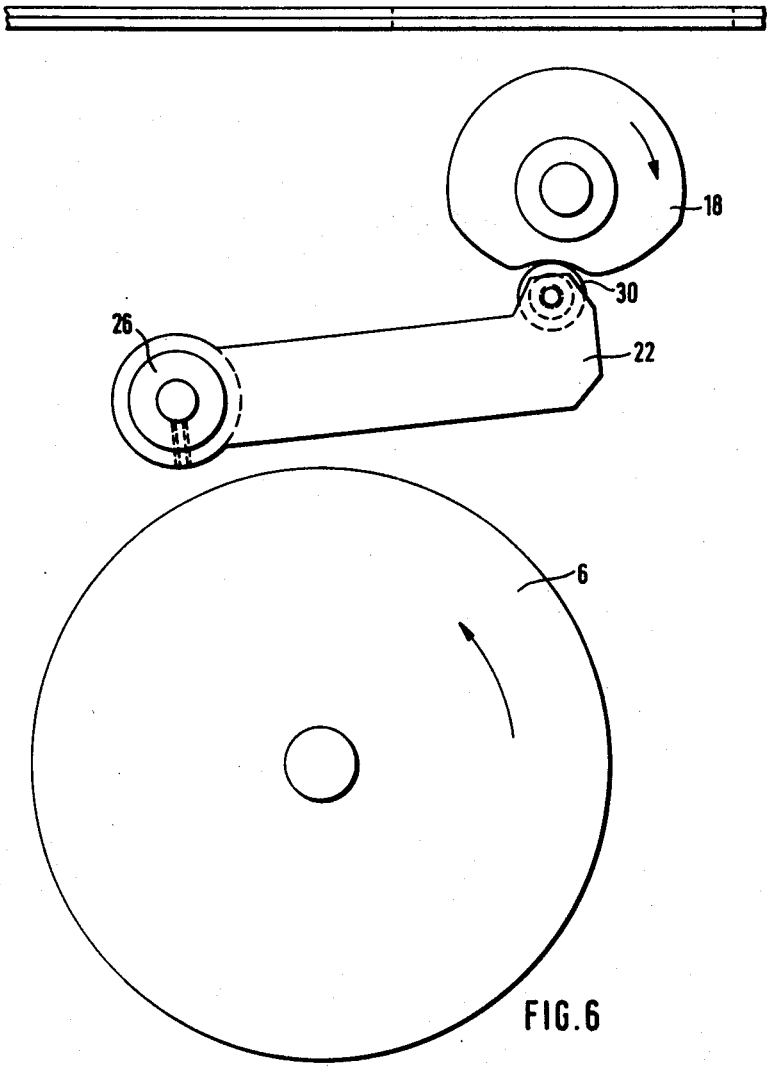
FIGS. 6 and 7 are partial views illustrating various parts of the embodiment represented in FIG. 2.
Figure 7:
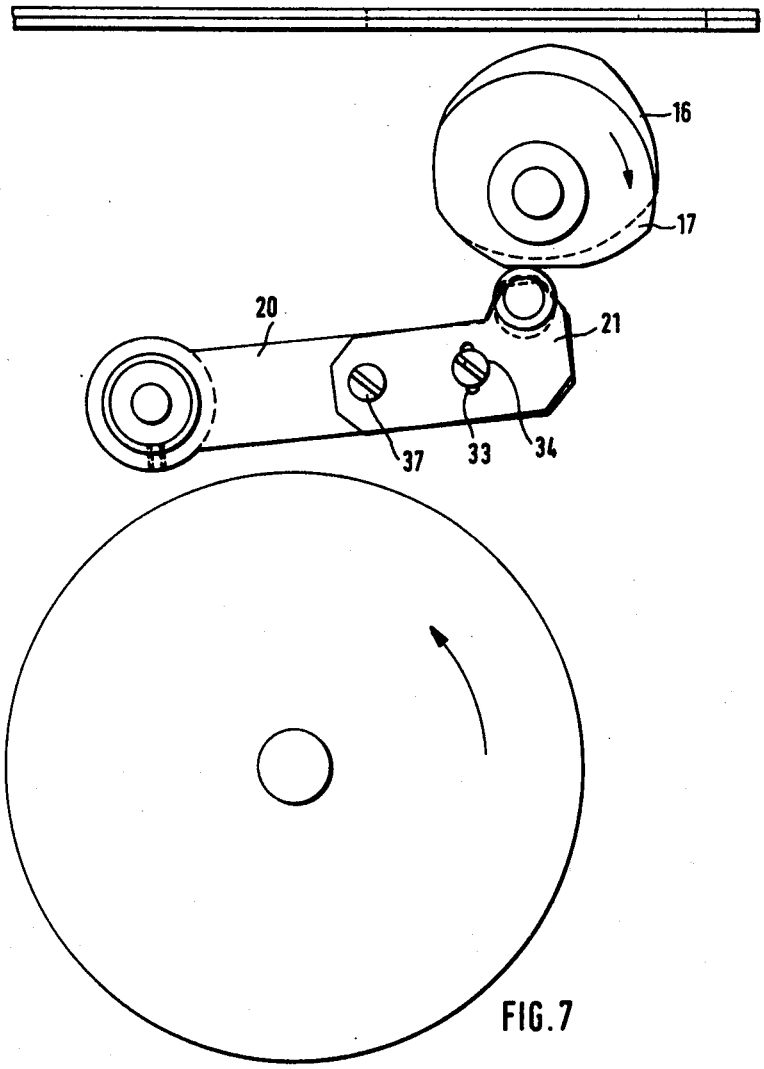

The two levers 20 and 21 are provided, with lever 21 being designed to be shorter than lever 20, for applying the cleaning roller 2, at different application-pressures, to the peripheral surface of the drum 6 and for lifting the roller from the drum surface. As can be seen from FIG. 7, the shorter lever 21 can be pivoted, to a slight extent, relative to the lever 20. For this purpose, a common pivot axis is provided, which is formed by a screw 37 connecting the two levers. In addition, the shorter lever 21 possesses an arcuate slot 33, for adjusting the relative position of the two levers by pivoting the lever 21 about the rotation-point formed by the shoulder-screw 37 and then fixing the position of lever 21 by means of locking screw 34, which passes through the slot 33. As can be recognized from the enlarged partial view according to FIGS. 6 and 7, the levers 20 and 22 are of equal lengths.

Referring again to FIG. 1, pins 38 and 39, positioned at the periphery and at one side of the sleeve 15, are fit into corresponding bores in the sideplate 42 to ensure that the sleeve 15 seats securely on the sideplate 42 in order to rotate the plate by the rotation of sleeve 15. The rotation of the sideplate is then transmitted to the other side, i.e., to the other sideplate, via the second profile-section tube 13.

A splash-guard 5, for example a foil, extending upwardly from the first profile section tube 8, and thus, scraper 3, prevents liquid toner, which is thrown upwardly by the cleaning roller 2, from emerging from the region of the sideplates 42 and wetting sub-assemblies located nearby.

A strip 1 is located between the splash-guard 5 and the cleaning roller 2, this strip extends over the length of the drum 6 and has a roof-profile which slopes downwardly from the mid-point of the strip and outwardly towards the two ends. The particular shape of the strip 1 ensures that liquid toner, which is present in the region which is laterally bounded by the splash-guard 5 and the cleaning roller 2, and is bounded in the downward direction by the scraper 3 and the peripheral surface of the photoconductor-drum, flows off, as quickly as possible, from the middle of the strip, outwardly towards its two ends. Deflectors 4, made of sheet material, are fastened to the ends of the strip 1. These deflectors bear against the inner surfaces of the drip-disks 7 and thus ensure that the cleaning liquid flows downwardly, from the deflectors, between the inner surface of the drip-disks 7 and the end-surfaces 36 of the drum 6, into the liquid bath (not shown). The cleaning liquid, which is generally the solvent of the liquid toner, is introduced via a spray-tube 11, located within the sideplates 42, above the strip 1, between the splash-guard 5 and the cleaning roller 2.

Figure 3:
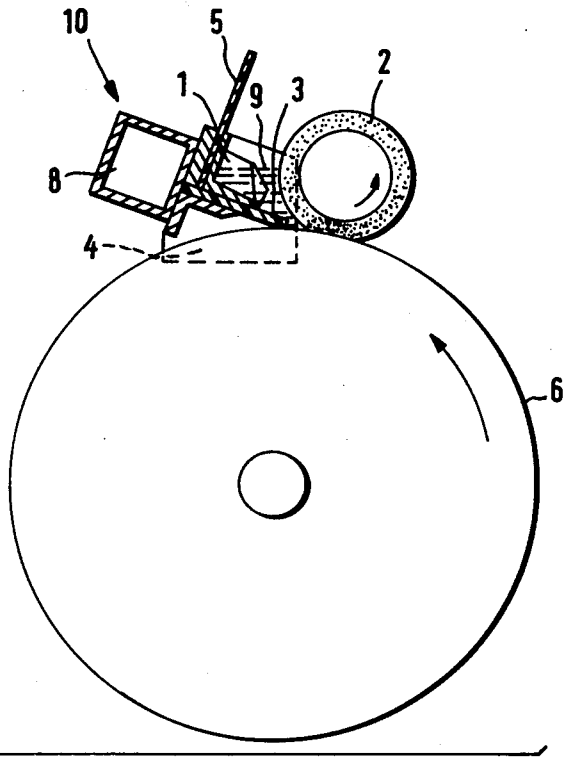
FIG. 3 is a diagrammatic representation illustrating parts of the cleaning device of FIG. 2 during cleaning.
Figure 3A:
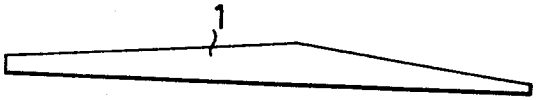
FIG. 3*a* is an enlarged schematic view of the strip of FIG. 3.

FIG. 3*a* shows the strip 1 in a detailed view, illustrating the downward slope of the strip from the mid-point towards the ends.

Figure 8:
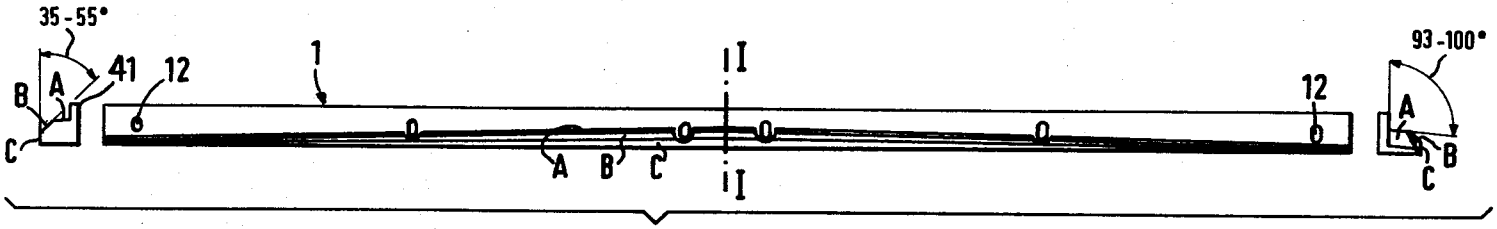
FIG. 8 is a frontal view of the strip according to FIG. 3*a;*.
Figure 9:
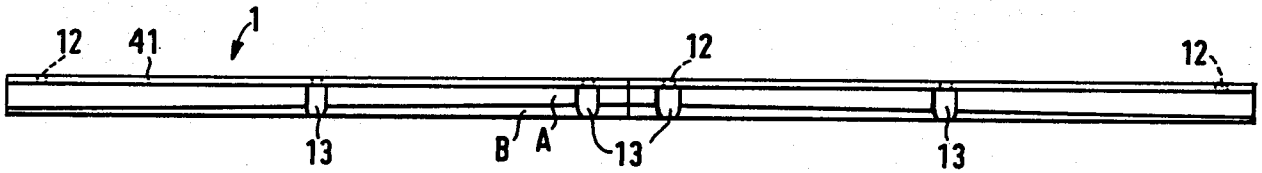
FIG. 9 is a plan view of the strip according to FIG. 8.

On the far lefthand side of FIG. 8 is shown a cross-sectional view, taken along line I—I through the mid-point of the strip 1 illustrating the varying slopes of the surfaces A and B. The surface A exhibits an angle of inclination of approximately 3° to 10°, preferably 5°, from the horizontal, while the angle of inclination of surface B ranges between 35° to 55°, preferably 45°, also with respect to the horizontal, or base surface of the strip 1. The surface A adjoins the front face of a web 41 of the strip 1, the splash-guard 5 (compare FIG. 3) being fastened to the rear face of this web. The surface B adjoins the surface A, and merges into a front surface C, which extends vertically therefrom. As can be seen from the plan view of FIG. 9, the surface A widens, in the longitudinal direction, from the mid-point of the strip 1, towards its edges, while the surface B narrows from the mid-point of the strip 1, towards the edges. The front surface C (compare FIG. 8) likewise narrows towards the edges. The surfaces A, B and C consequently slope downwardly from the mid-point of the strip 1, towards the edges.

The web 41 possesses a constant thickness over the entire length of the strip 1. Holes 12 are distributed in the web 41, over the length of the strip 1. The holes receive fastening-means, such as screws (not shown), for mounting the strip 1 on the cleaning device 10, or, if appropriate, on a plate which is fastened to the profile-section tube 8 (not shown in detail). For this purpose, it is necessary to make notch-like indentations 13 in the strip 1, in order to provide access to the holes 12. These notch-like indentations are shaped as downward-pointing half-cylinders, being open in the upward direction, and being bounded by vertical sidewalls.

During the copying process, the toner liquid rises in the gutter, which is formed by the cleaning roller 2, the scraper 3 and the strip 1 (compare FIG. 3). In this gutter, the rise initially reaches the edge between the surfaces B and C. Upon further rising, the geometry of the strip 1 causes the toner liquid to flow off, in an accelerated manner, towards the edges of the strip 1 and thus off the drum 6. When, as the copying process ends, the cleaning roller 2 is squeezed out, toner liquid is released to an extent such that it rises above and beyond the edge between the surfaces B and A. As a result of this rise, the toner liquid enters the region of the steeper descending gradient of the strip 1, in the outward direction, and is more rapidly led away towards the edges.

In FIG. 8, to the right of the strip 1, is represented a side view of the strip 1, to the center line I—I. This side view clearly illustrates both the inclination of the surface A, which is inclined towards the edge and which widens in this direction, and the surface B which narrows towards the edge.

The mode of operation of the cleaning device 10 is explained in more detail below, with the aid of the FIGS. 3 to 5.

FIG. 3 illustrates the position of the cleaning device 10 during the copying process. The scraper 3 and the cleaning roller 2 are simultaneously pivoted into contact with the peripheral surface of the drum 6. The cleaning liquid 9 is dammed-up between the scraper 3 and the cleaning roller 2, in order to soften and dissolve any liquid toner which may possibly have dried on the drum surface. Both cleaning elements, i.e., the roller and scraper, are likewise wetted by the toner in this arrangement. The contact pressure of the scraper 3 is adjusted in such a manner that the surface of the drum 6 is as dry as possible after the scraper 3 has passed. The cleaning roller 2 rotates counter to the rotation of the drum 6. The contact pressure of the cleaning roller 2, against the peripheral surface of the drum 6, is adjusted to be sufficiently high so as to prevent the cleaning liquid 9 from escaping between the cleaning roller 2 and the peripheral surface of the drum 6.

Figure 4:
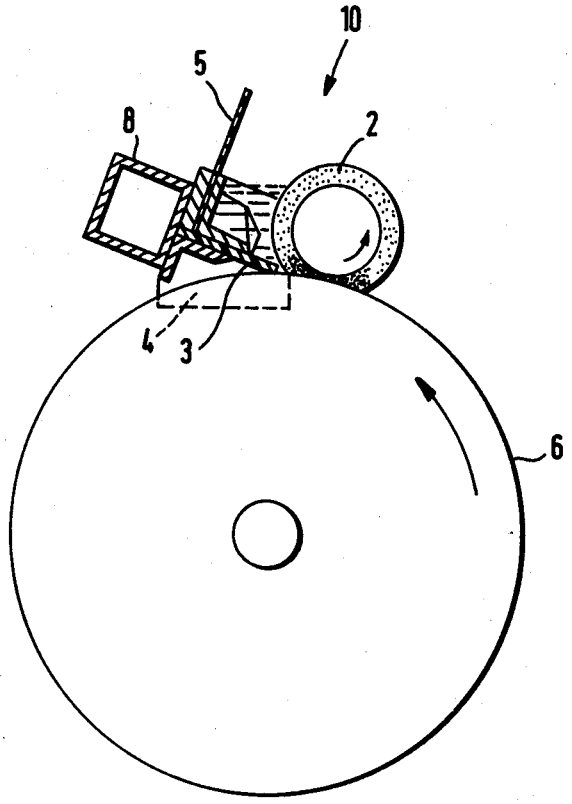
FIG. 4 is a diagrammatic representation of the cleaning device similar to FIG. 3, during the squeezing-off of the cleaning roller, after completion of the cleaning.

After completion of the copying process, the scraper 3 remains, as shown in FIG. 4, in its cleaning position. The flow of the cleaning liquid for rinsing and wetting the cleaning elements 3 and 4 is interrupted, and the cleaning roller 2 is pressed more heavily against the peripheral surface of the drum 6. In this squeezing out-position, the gap between the core of the cleaning roller 2 and the peripheral surface of the drum 6 becomes smaller. In so doing the cleaning liquid or liquid toner, which has collected in the foamed material is pressed out. As a result of the heavy pressing of the cleaning roller 2, the foamed material is so greatly deformed, at the pressure-point, that the scraper 3 and the cleaning roller 2 practically touch each other in this position. During this operation, the cleaning liquid flows away, over the strip 1, in the outwardly direction. After completion of this squeezing operation, the drive of the drum 6, and of the cleaning roller 2, is stopped. The residual liquid, which is still present between the scraper 3 and the cleaning roller 2, is absorbed by the foamed material of the cleaning roller 2 as the cleaning device 10 is slowly folded up into the position shown in FIG. 5, so that even the last residue cleaning liquid is removed from the peripheral surface of the drum 6.

Figure 5:
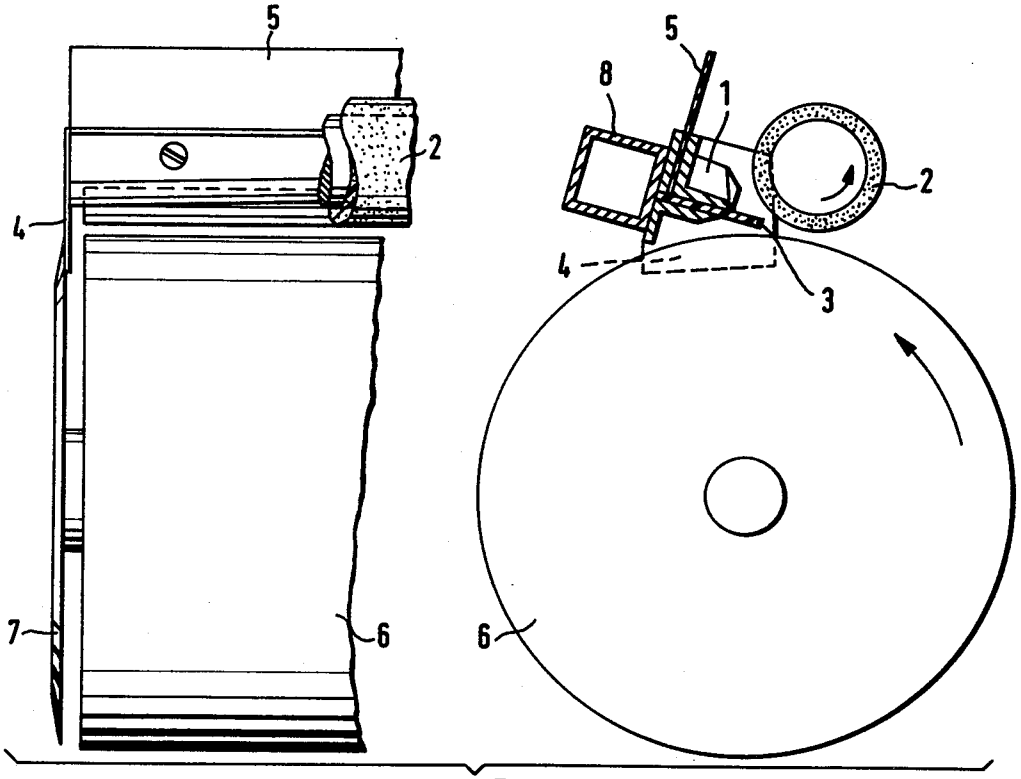
FIG. 5 is a diagrammatic representation of the cleaning device in the rest position.

On being pivoted clear of the peripheral surface of the drum 6, the scraper 3 lifts, after a time delay, from the peripheral surface, after which the cleaning device 10 pivots into the rest position shown in FIG. 5.

The advantage of the present invention resides in the cleaning roller being pressed against the photoconductor-surface at different pressures, thereby achieving a two-fold result. First, the cleaning roller is compressed and squeezed, during the cleaning operation at a low contact force, and therefore no cleaning liquid or developer liquid runs down over the photoconductor-surface, and secondly, while at a higher contact pressure, the cleaning roller is so greatly deformed during the squeezing operation that the stored liquid is squeezed from the roller and the roller practically contacts the scraper. After the photoconductor and the cleaning roller have come to a stop, the residual liquid, which is then still present on the photoconductor-surface, between the scraper and the cleaning roller, is absorbed by the cleaning roller, as the cleaning device is slowly pivoted away.

Another advantage of the invention is that the interspace between the cleaning roller, the scraper and the strip is kept so narrow that, when the cleaning device is hinged against the photo-conductor-drum, a narrow gutter is formed, in which the toner liquid rises, up to the upper surface of the strip, and then, as a result of the geometry of the strip, runs off, towards the edges of the drum, in an accelerated manner.

What is claimed is:

1. A cleaning device for cleaning the peripheral surface of a photoconductive drum of an electrophotographic copier, comprising:

a cleaning roller;

a scraper including means for preventing liquid overflow;

a strip extending along the entire drum surface and positioned between said roller and said overflow prevention means, said strip having a downwardly outwardly sloping surface from the central apex toward the ends; and a lever device comprising a plurality of levers, one lever being separately positioned on a shaft from the remaining levers positioned on a surrounding sleeve, and a plurality of cam-disks in pressure contact with said levers, respectively for pivoting and positioning said roller and scraper.

2. A cleaning device as defined in claim 1, further comprising a means for providing a cleaning liquid to said peripheral drum surface.

3. A cleaning device as defined in claim 2, wherein said liquid providing means comprises a spray tube.

4. A cleaning device as defined in claim 1, wherein said cam-disks comprise different shapes and are actuated at delayed times and to different extents to provide varying pressures to said roller and scraper.

5. A cleaning device as defined in claim 4, wherein said cam-disks are positioned on a common shaft and further comprising a toothed drive wheel driven by an inverted toothed chain for driving said shaft.

6. A cleaning device as defined in claim 1, wherein said levers positioned on said sleeve supply varying pressures for applying said cleaning roller to said drum surface and for lifting said roller from said drum.

7. A cleaning device as defined in claim 6, wherein two levers are positioned on said sleeve and wherein said levers comprise different lengths and are pivotally connected.

8. A cleaning device as defined in claim 7, wherein said pivot means comprises a locking screw for positioning and locking said levers in relation to one another.

9. A cleaning device as defined in claim 1, wherein said overflow prevention means comprises a splash guard extending upwardly from said scraper.

10. A cleaning device as defined in claim 1, further comprising:

a drip disk positioned parallel to the end surface of said drum on the shaft of said drum;

a deflector contacting the upper area of said drip disk and extending parallel thereto for preventing toner liquid from emerging from the drum.

11. A cleaning device as defined in claim 1, further comprising side plates positioned at opposite ends of said cleaning roller for supporting said roller.

12. A cleaning device as defined in claim 1, wherein said strip is positioned above said scraper and comprises flow surfaces of different gradients.

13. A cleaning device as defined in claim 12, wherein said strip comprises a web wherein the front face of said web comprises the surfaces of different gradient and wherein said splash-guard is positioned on the rear face of said web.

14. A cleaning device as defined in claim 13, wherein the first of said surfaces adjoins the front face of said web and comprises a shallower descending gradient in the transverse direction of said web than the second of said surfaces which adjoins said first surface.

15. A cleaning device as defined in claim 14, wherein said first surface widens, in the longitudinal direction, from the mid-point of said strip, towards the edges.

16. A cleaning device as defined in claim 15, wherein said second surface narrows, from the mid-point of the strip, towards the edges.

17. A cleaning device as defined in claim 15, wherein said web comprises a constant thickness over the entire length of said strip.

18. A cleaning device as defined in claim 13, further comprising apertures through said web and distributed over the length of said strip for mounting the strip to the cleaning device.

19. A cleaning device as defined in claim 13, further comprising:

disk-shaped flow control means positioned parallel to the end surfaces of the drum, a short distance therefrom; and deflection means fastened to the ends of said strip and bearing against the inner surface of said disk-shaped flow control means.

20. A process for cleaning the peripheral surface of a photoconductive drum of an electrophotographic copier, comprising the steps of:

introducing a cleaning device comprising a cleaning roller and a scraper to the peripheral surface of the drum;

individually controlling the contact pressure of said roller and scraper, said roller and scraper being positioned parallel to one another;

supplying a cleaning liquid to the space between said roller and said scraper to contact said peripheral surface;

upon completion of copying, individually applying increased pressure to said roller to cause more intimate contact with said drum and said scraper to squeeze cleaning liquid therefrom; and lifting said cleaning device from said peripheral surface upon absorption by said roller of any remaining cleaning fluid.

* * * * *